US007545126B2

(12) United States Patent
Su et al.

(10) Patent No.: US 7,545,126 B2
(45) Date of Patent: Jun. 9, 2009

(54) CONTROLLER FOR SENSING A HEAVY LOAD AND A SHORT CIRCUIT OF LOW DROPOUT REGULATORS

(75) Inventors: Chih-Heng Su, Kao-Hsiung (TW); Hung-Chun Yeh, Hsinchu (TW)

(73) Assignee: Anpec Electronics Corporation, Hsin-Chu (TW)

( * ) Notice: Subject to any disclaimer, the term of this patent is extended or adjusted under 35 U.S.C. 154(b) by 373 days.

(21) Appl. No.: 11/608,840

(22) Filed: Dec. 10, 2006

(65) Prior Publication Data

US 2007/0285071 A1 Dec. 13, 2007

Related U.S. Application Data

(60) Provisional application No. 60/804,561, filed on Jun. 12, 2006.

(51) Int. Cl.
*G05F 1/565* (2006.01)

(52) U.S. Cl. ..... 323/273; 323/901

(58) Field of Classification Search ..... 323/273–281, 323/901

See application file for complete search history.

(56) References Cited

U.S. PATENT DOCUMENTS 5,898,554 A * 4/1999 Schnetzka et al. ..... 361/18

6,252,409 B1 6/2001 Iijima

FOREIGN PATENT DOCUMENTS

TW 463950 11/2001
TW I254135 5/2006

* cited by examiner

*Primary Examiner*—Jeffrey L Sterrett
*Assistant Examiner*—Fred E Finch, III
(74) *Attorney, Agent, or Firm*—Winston Hsu

(57) ABSTRACT

A method capable of sensing a heavy load and a short circuit of a low dropout regulator includes providing a ramp pulse signal to the low dropout regulator, providing a square waveform, comparing a feedback signal of the low dropout regulator with the square waveform, and determining the low dropout regulator is a heavy load or a short circuit if a duration that the feedback signal is greater than a low voltage level of the square waveform and lower than a high voltage level of the square waveform is not greater than a pulse width of the square waveform. The method includes determining the low dropout regulator is a light load if the duration that the feedback signal is greater than the low voltage level of the square waveform and lower than the high voltage level of the square waveform is greater than the pulse width of the square waveform.

20 Claims, 10 Drawing Sheets

CONTROLLER FOR SENSING A HEAVY LOAD AND A SHORT CIRCUIT OF LOW DROPOUT REGULATORS

CROSS REFERENCE TO RELATED APPLICATIONS

This application claims the benefit of U.S. Provisional Application No. 60/804,561, filed Jun. 12, 2006, and included herein by reference.

BACKGROUND OF THE INVENTION

1. Field of the Invention

The present invention relates to a method and related controller capable of sensing a heavy load and a short circuit of a low dropout regulator, and more particularly, to a method and related controller that compares a feedback signal of the low dropout regulator with a square waveform to determine a heavy load and a short circuit.

2. Description of the Prior Art

Generally speaking, supply voltages utilized by integrated circuit chips come from systems. For examples, supply voltages for network chips, wireless communication chips, or image processing chips disposed in desktops or laptop computers are provided by motherboards. However in a general case, input voltages (such as 5V or 3V) generated by systems are too high to be used directly as supply voltages (such as 1.5V) in IC chips unless certain voltage converting circuits first convert input voltages into a lower voltage level that suits IC's use.

Typical voltage converting circuits include switching regulators and linear regulators. Switching regulators achieve high power efficiency. For example, if a 3V input voltage is to be converted into a 1.5V supply voltage, the switching regulator achieves high power efficiency, even close to 90%, but an off-chip inductor or capacitor is required. Off-chip components such as inductors or capacitors are not only expensive but also large in volume. Besides, the switching regulator causes ripple effects at the voltage output, and results in unstable output voltages. Linear regulators have strong points of quick response, stable output voltage, and low noise and always are applied to analog circuits or critical voltages. A common linear regulator such as a low dropout regulator is applied to stepdown only due to the low dropout regulator having high power consumption and low transformation efficiency although it has strong points of low cost, small package, and low noise. The transformation efficiency of a low dropout regular having a 3.6V input voltage and a 1.5V output voltage is merely 41.7% due to the transformation efficiency of the low dropout regular depending on ratio of the output voltage to the input voltage. Such low transformation efficiency not only wastes energy but also causes chips to have a temperature that may influence system stability when output currents are large.

Please refer to FIG. 1 that is a diagram of a low dropout regulated circuit 10 in the prior art. The low dropout regulated circuit 10 includes a low dropout regulator 12 and a controller 14. The low dropout regulator 12 is used for transforming an input voltage Vin into an output voltage Vout where the output voltage Vout is smaller than the input voltage Vin. The controller 14 is used for driving the low dropout regulator 12 and includes a driving transistor Q1, a first resistor R1, a second resistor R2, a capacitor C1, and an output capacitor Cout. The driving transistor Q1 has a control end 102, a first end 104, and a second end 106. The control end 102 is used for receiving a driving signal DRV1, the first end 104 is used for inputting the input voltage Vin, and the second end 106 is used for outputting the output voltage Vout. The capacitor C1 is coupled between the input voltage Vin and the first end 104 of the driving transistor Q1 for filtering noise of the input voltage Vin.

The first resistor R1 has a first end 312 and a second end 314. The first end 312 is coupled to the second end 106 of the driving transistor Q1, and the second end 314 is used for outputting a feedback signal FB1. The second resistor R2 has a first end 322 and a second end 324. The first end 322 is coupled to the second end 314 of the first resistor R1 in series, and the second end 324 is coupled to ground. A magnitude of the feedback signal FB1 is decided by a ratio of the first resistor R1 to the second resistor R2. The output capacitor Cout is coupled to the output voltage Vout as a loading of the low dropout regulator 12.

The controller 14 includes an amplifier 15. The amplifier 15 has a first input end 152, a second input end 154, and an output end 156. The first input end 152 is used for receiving a reference voltage Vref, the second input end 154 is coupled to the second end 314 of the first resistor R1 and to the second end 324 of the second resistor R2 for receiving the feedback signal FB1, and the output end 256 is coupled to the control end 102 of the driving transistor Q1 for outputting the driving signal DRV1 to the driving transistor Q1. The amplifier 15 outputs the driving signal DRV1 in high level to the driving transistor Q1 and the driving transistor Q1 is turned on when the reference voltage Vref is greater than the feedback signal FB1. The low dropout regulator 12 transforms the input voltage Vin into the output voltage Vout normally. The amplifier 15 outputs the driving signal DRV1 in low level to the driving transistor Q1 and the driving transistor Q1 is turned off when the reference voltage Vref is smaller than the feedback signal FB1. The driving transistor Q1 is a metal-oxide semiconductor transistor (MOS).

Please refer to FIG. 2 that is a diagram of a low dropout regulated circuit 20 in the prior art. The regulated circuit 20 includes a low dropout regulator 22 and a controller 24. A difference between FIG. 1 and FIG. 2 is that the driving transistor Q1 is installed inside the controller 24 of the low dropout regulated circuit 20 and a current $I_1$ flowing into the driving transistor Q1 is calculated by a resistor R. The low dropout regulator 22 is used for transforming the input voltage Vin into the output voltage Vout where the output voltage Vout is smaller than the input voltage Vin. The controller 24 is used for driving the low dropout regulator 22.

The low dropout regulator 22 includes the first resistor R1, the second resistor R2, the capacitor C1, and the output capacitor Cout. The controller 24 includes an amplifier 25, the driving transistor Q1, and the transistor R. The driving transistor Q1 has the control end 102, the first end 104, and the second end 106. The control end 102 is used for receiving the driving signal DRV1, the first end is used for inputting the input voltage Vin, and the second end 106 is coupled to the resistor R. The resistor R has a first end 222 and a second end 224. The first end 222 is coupled to the second end 106 of the driving transistor Q1, and the second end 224 is used for outputting the output voltage Vout. The resistor R is used for measuring the current $I_1$ flowing into the driving transistor Q1. The capacitor C1 is coupled to the input voltage Vin and to the first end 104 of the first end 104 of the driving transistor Q1 for filtering noise from the input voltage Vin. The first resistor R1 has the first end 312 and the second end 314. The first end 312 is coupled to the second end 224 of the resistor R, and the second end 314 is used for outputting the feedback FB1. The second resistor R2 has the first end 322 and the second end 324. The first end 322 is coupled to the second end 314 of the first transistor R1 in series, and the second end 324 is coupled to ground.

The magnitude of the feedback signal FB1 is decided by the ratio of the first resistor R1 to the second resistor R2. The output capacitor Cout is coupled to the output voltage Vout as a loading of the low dropout regulator 22. The controller 24 includes an amplifier 25. The amplifier 25 has a first input end 252, a second input end 254, and an output end 256. The first input end 252 is used for receiving the reference voltage Vref, the second input end 254 is coupled to the second end 314 of the first resistor R1 and to the second end 324 of the second resistor R2 for receiving the feedback signal FB1, and the output end 256 is coupled to the control end 102 of the driving transistor Q1 for outputting the driving signal DRV1 to the driving transistor Q1. The driving transistor Q1 is turned off to protect the driving transistor Q1 when the current $I_1$ measured by the resistor R is too large. The driving transistor Q1 is a metal-oxide semiconductor transistor (MOS).

Typical low dropout regulated circuits presently will not only waste energy but also cause chipsets have a temperature that influences system stability due to large power consumption when working in conditions of a heavy load or a larger current. Moreover, even the driving transistor Q1 is burned out if the low dropout regulated circuits is under a heavy load for a long time. Although the low dropout regulated circuit 20 is capable of detecting the current $I_1$ flowing into the driving transistor Q1 to further provide current protections to the low dropout regulated circuit 20, a resistor R is needed, raising costs and will consume power by itself. The driving transistor Q1 is installed inside the controller 24 and is restricted to a fixed transistor.

SUMMARY OF THE INVENTION

The claimed invention provides a method capable of sensing a heavy load and a short circuit of a low dropout regulator. The method includes providing a ramp pulse signal to the low dropout regulator, providing a square waveform, comparing a feedback signal of the low dropout regulator with the square waveform, and determining the low dropout regulator is a heavy load or a short circuit if a duration that the feedback signal is greater than a low voltage level of the square waveform and lower than a high voltage level of the square waveform is not greater than a pulse width of the square waveform. The method further includes determining the low dropout regulator is a light load if the duration that the voltage of the feedback signal is greater than the low voltage level of the square waveform and lower than the high voltage level of the square waveform is greater than the pulse width of the square waveform, determining the low dropout regulator is a light load if a duration that the feedback signal is greater than the high voltage level of the square waveform is greater than a designated time, and determining the low dropout regulator is a heavy load if the duration that the feedback signal is greater than the high voltage level of the square waveform is not greater than the designated time.

The claimed invention provides a controller capable of sensing a heavy load and a short circuit of a low dropout regulator. The controller includes a driving circuit, a square waveform generator, a compare circuit, and a judgment module. The driving circuit is used for providing a driving signal to the low dropout regulator. The square waveform generator is used for providing a square waveform. The compare circuit is used for comparing a feedback signal of the low dropout regulator with the square waveform. The judgment module is used for determining the low dropout regulator is a heavy load or a short circuit if a duration that the feedback signal is greater than a low voltage level of the square waveform and lower than a high voltage level of the square waveform is not greater than a pulse width of the square waveform. The judgment module is further used for determining the low dropout regulator is a light load if the duration that the feedback signal is greater than the low voltage level of the square waveform and lower than the high voltage level of the square waveform is greater than the pulse width of the square waveform. The judgment module is further used for determining the low dropout regulator is a light load if a duration that the feedback signal is greater than the high voltage level of the square waveform is greater than a designated time. The judgment module is further used for determining the low dropout regulator is a heavy load if the duration that the feedback signal is greater than the high voltage level of the square waveform is not greater than the designated time.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
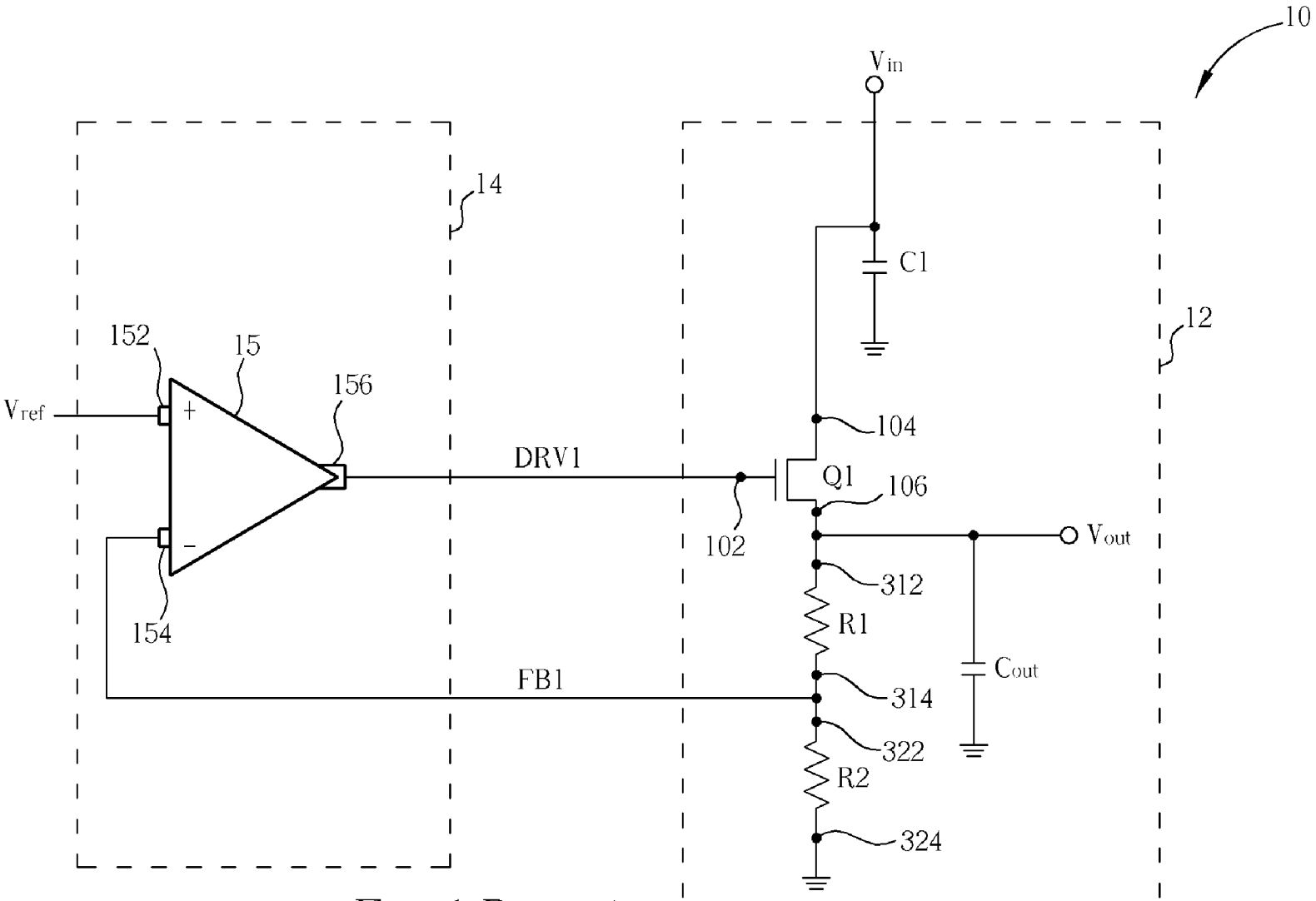
Fig. 1 Prior Art
FIG. 1 is a diagram of a low dropout regulated circuit in the prior art.
Figure 2:
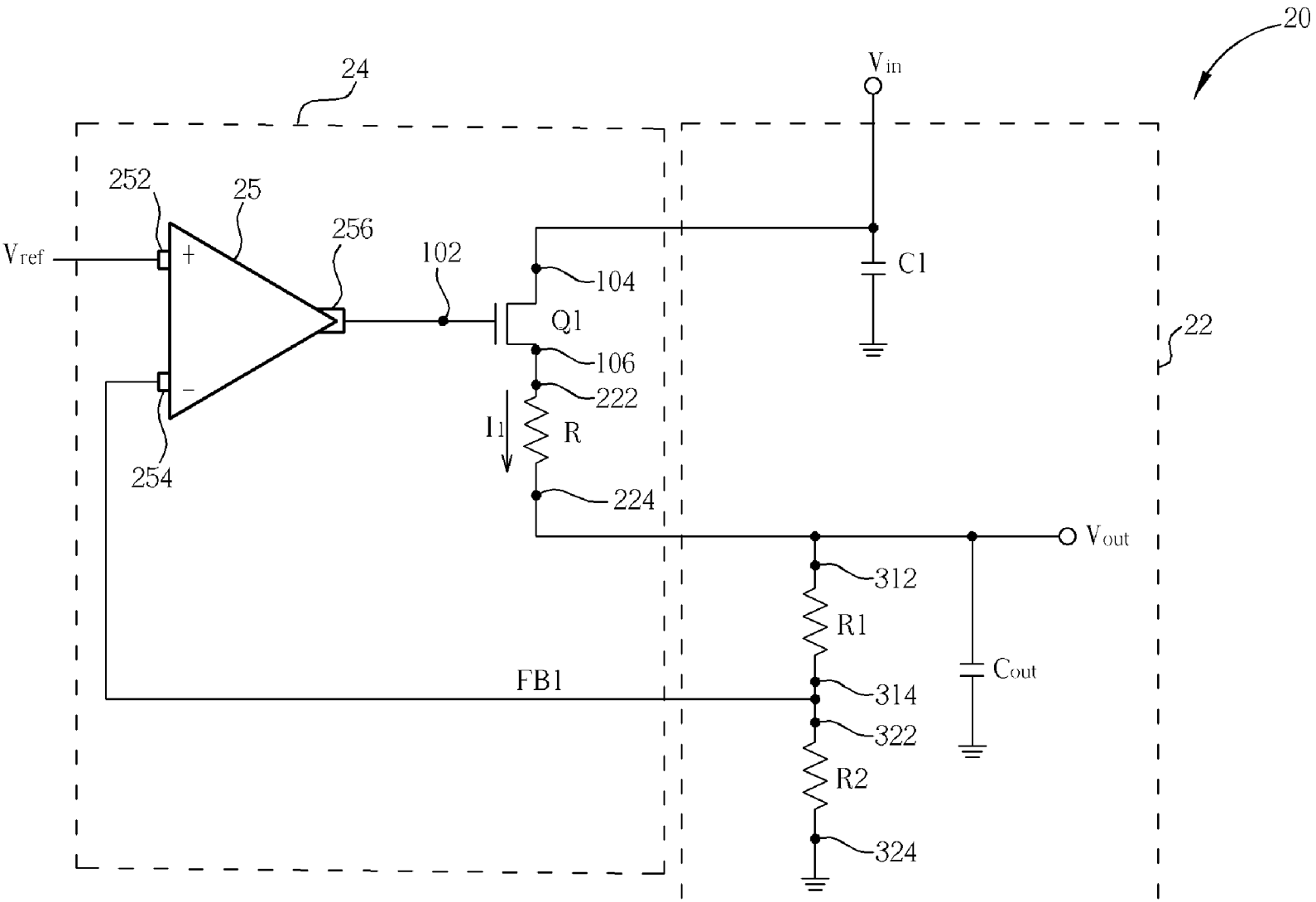
Fig. 2 Prior Art
FIG. 2 is a diagram of another low dropout regulated circuit in the prior art.
Figure 3:
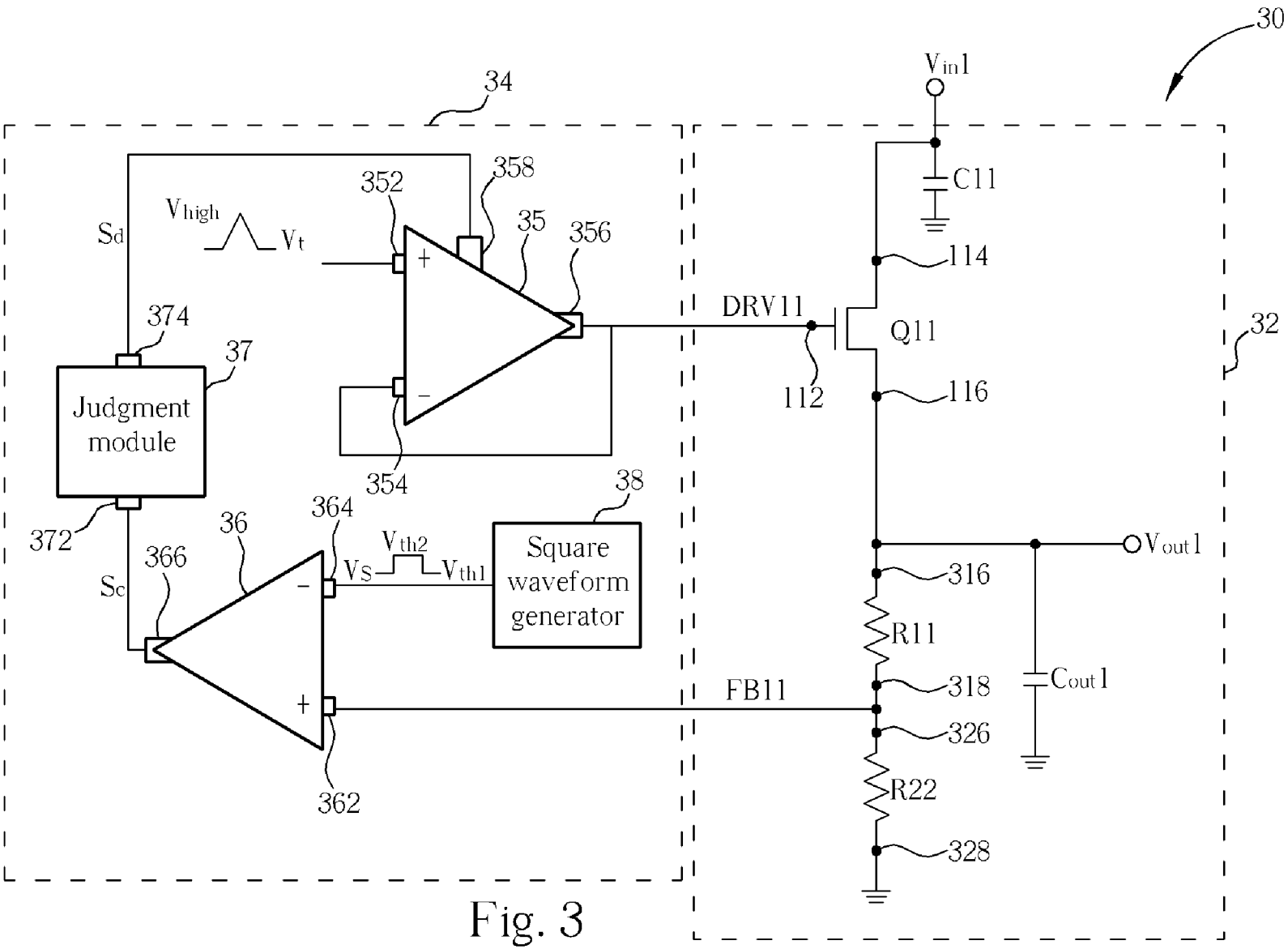
FIG. 3 is a diagram illustrating a low dropout regulated circuit capable of sensing a heavy load and a short circuit of a low dropout regulator according to an embodiment of the present invention.

Please refer to FIG. 3. FIG. 3 is a diagram illustrating a low dropout regulated circuit 30 capable of sensing a heavy load and a short circuit of a low dropout regulator according to an embodiment of the present invention. The low dropout regulated circuit 30 includes a low dropout regulator 32 and a controller 34. The low dropout regulator 32 is used for transforming an input voltage Vin1 into an output voltage Vout1 where the output voltage Vout1 is smaller than the input voltage Vin1. The controller 34 is used for driving the low dropout regulator 32 and includes a driving transistor Q11, a first resistor R11, a second resistor R22, a capacitor C11, and an output capacitor Cout1. The driving transistor Q11 has a control end 112, a first end 114, and a second end 116. The control end 112 is used for receiving the driving signal DRV1, the first end 114 is used for inputting the input voltage Vin1, and the second end 116 is used for outputting the output voltage Vout1. The capacitor C11 is coupled between the input voltage Vin1 and the first end 114 of the driving transistor Q11 for filtering noise of the input voltage Vin1. The first resistor R11 has a first end 316 and a second end 318. The first end 316 is coupled to the second end 116 of the driving transistor Q11, and the second end 318 is used for outputting a feedback signal FB11. The second resistor R22 has a first end 326 and a second end 328. The first end 326 is coupled to the second end 318 of the first resistor R11 in series, and the second end 328 is coupled to ground.

A magnitude of the feedback signal FB11 is decided by a ratio of the first resistor R11 to the second resistor R22. The output capacitor Cout1 is coupled to the output voltage Vout1 as a loading of the low dropout regulator 32. The controller 34 includes a driving circuit 35, a square waveform generator 38, a compare circuit 36, and a judgment module 37. The driving circuit 35 is used for providing a driving signal DRV11 to the low dropout regulator 32. The square waveform generator 38 is used for providing a square waveform Vs. The compare circuit 36 is used for comparing a feedback signal FB11 of the low dropout regulator 32 with the square waveform Vs.

Please keep referring to FIG. 3. The driving circuit 35 is an error amplifier and has a first input end 352, a second input end 354, a control end 358, and an output end 356. The first input end 352 is used for receiving a ramp pulse signal Vt, the second input end 354 is coupled to the output end 356, the control end 358 is coupled to an output end 374 of the judgment module 37 for receiving a judgment signal Sd, and the output end 356 is coupled to the control end 112 of the driving transistor Q1. The driving circuit 35 is used for generating the driving signal DRV11 according to the judgment signal Sd. The square waveform generator 38 is used for providing the square waveform Vs.

A low level of the square waveform Vs is a first threshold voltage Vth1, a high level of the square waveform Vs is a second threshold voltage Vth2, and a pulse width is T1. The compare circuit 36 can be a comparator and has a first input end 362, a second input end 364, and an output end 366. The first input end 362 is coupled to the second end 318 of the first resistor R1 and to the first end 326 of the second resistor R2 for receiving the feedback signal FB11, the second input end 364 is coupled to the square waveform generator 38 for receiving the square waveform Vs, and the output end 366 is used for outputting a compare signal Sc. The compare circuit 36 is used for generating the compare signal Sc according to a result of comparing the feedback signal FB11 with the square waveform Vs. The judgment module 37 has an input end 372 and an output end 374. The input end 372 is coupled to the output end 366 of the compare circuit 36 for receiving the compare signal Sc, and the output end 374 is coupled to the control end 358 of the driving circuit 35 for outputting the judgment signal Sd.

Operations of the judgment module 37 are described in the following. The judgment module 37 determines the low dropout regulator 32 is a heavy load or a short circuit if a duration that the feedback signal FB11 is greater than the first threshold voltage Vth1 of the square waveform Vs and lower than the second threshold voltage Vth2 of the square waveform Vs is not greater than the pulse width T1 of the square waveform Vs. The judgment module 37 determines the low dropout regulator 32 is a light load if the duration that the feedback signal FB11 is greater than the first threshold voltage Vth1 of the square waveform Vs and lower than the second threshold voltage Vth2 of the square waveform Vs is greater than the pulse width T1 of the square waveform Vs. The judgment module 37 determines the low dropout regulator 32 is a light load if a duration that the feedback signal FB11 is greater than the second threshold voltage Vth2 of the square waveform Vs is greater than a designated time T2. The judgment module 37 determines the low dropout regulator 32 is a heavy load if the duration that the feedback signal FB11 is greater than the second threshold voltage Vth2 of the square waveform Vs is not greater than the designated time T2. Therefore, the judgment module 37 is capable of determining whether the low dropout regulator 32 is a heavy load by relationships between the feedback signal FB11 and the square waveform Vs.

Going a step further, the driving circuit 35 will provide the driving signal DRV11 to the low dropout regulator 32 after waiting for a delay time Tdelay when the low dropout regulator 32 is determined a heavy load or a short circuit. The low dropout regulator 32 will transform voltages normally when the low dropout regulator 32 is determined a light load. The driving signal DRV11 can be a triangle waveform, a square waveform, or waveforms in other types. Hence, the driving circuit is capable of determining whether to provide the driving signal DRV11 to the low dropout regulator 32 after waiting for the delay time Tdelay or not according to judgment results from the judgment module 37.

Figure 4:
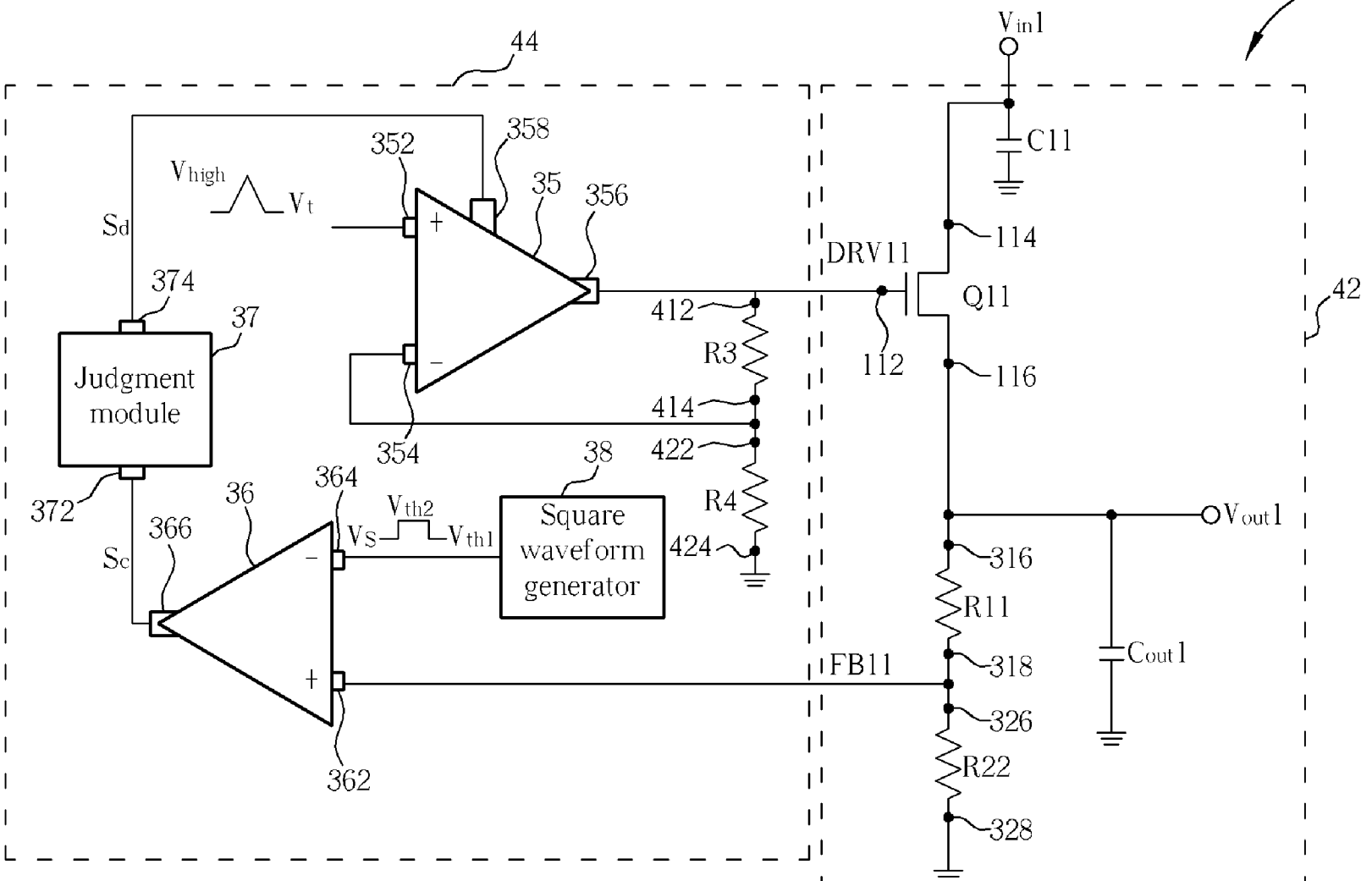
FIG. 4 is a diagram illustrating a low dropout regulated circuit capable of sensing a heavy load and a short circuit of a low dropout regulator according to another embodiment of the present invention.

Please refer to FIG. 4. FIG. 4 is a diagram illustrating a low dropout regulated circuit 40 capable of sensing a heavy load and a short circuit of a low dropout regulator according to another embodiment of the present invention. The low dropout regulated circuit 40 is similar to the low dropout regulated circuit 30 and includes the low dropout regulator 32 and a controller 44. A difference between FIG. 3 and FIG. 4 is that the controller 44 further includes a third resistor R3 and a fourth resistor R4 for adjusting amplification factors of the driving circuit 35. The third resistor R3 has a first end 412 and a second end 414. The first end 412 is coupled to the output end 356 of the driving circuit 35, and the second end 414 is coupled to the second end 354 of the driving circuit 35. The fourth resistor R4 has a first end 422 and a second end 424. The first end 422 is coupled to the third resistor R3 and to the second output end 354 of the driving circuit 35, and the second end 424 is coupled to ground. Relationships between the driving signal DRV11 and the ramp pulse signal Vt can be expressed as:

$$Vt \equiv DRV1 \times \frac{R4}{R3 + R4}.$$

The driving signal DRV11 can be adjusted by adjusting the third resistor R3 and the fourth resistor R4.

Figure 5:
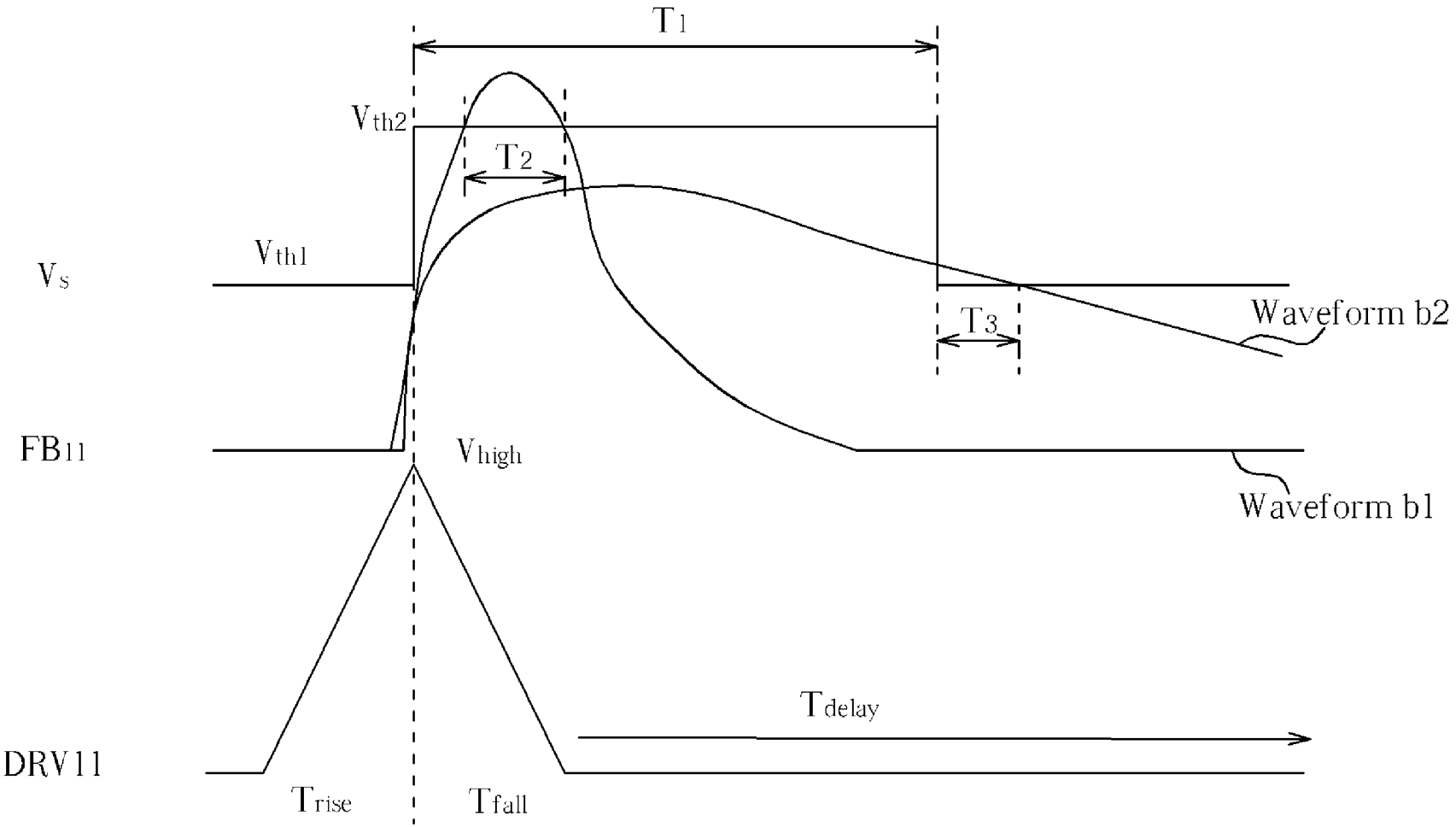
FIG. 5 is a diagram illustrating signal waveforms in FIG. 4.

Please refer to FIG. 5 that is a diagram illustrating signal waveforms in FIG. 4. The driving signal DRV11 is transmitted to the low dropout regulator 32 by utilizing the driving circuit 35 to amplify the ramp pulse signal Vt. The feedback signal FB11 is transmitted to the compare circuit 36 to be compared with the square waveform Vs by the low dropout regulator 32. The square waveform generator 38 is used for generating the square waveform Vs that has the low level being the first threshold voltage Vth1, the high level being the second threshold voltage Vth2, and the pulse width T1. As shown in FIG. 5, the upper waveform is the square waveform Vs, the middle waveform is the feedback signal FB11 in two possible conditions, and the lower waveform is the driving signal DRV11. The times T2 and T3 are used for determining a boundary value between a light load and a heavy load. The driving signal DRV11 is a triangle waveform. Trise is a rising time of the driving signal DRV11, Tfall is a falling time of the driving signal DRV11, Vhigh is its highest voltage level, and Tdelay is a delay time apart from a next ramp pulse. The driving signal DRV1 starts to decrease when the feedback signal FB11 reaches the first threshold voltage Vth1.

In the first condition, the low dropout regulator 32 is determined a light load and works normally when a duration that the waveform b1 of the feedback signal FB11 is greater than the second threshold voltage Vth2 is greater than the time T2. In the second condition, the low dropout regulator 32 is determined a light load and works normally when a duration that the waveform b1 of the feedback signal FB11 is greater than the first threshold voltage Vth1 and smaller than the second threshold voltage Vth2 is greater than time (T1+T3). In other conditions, the low dropout regulator 32 is determined a heavy load or a short circuit. Therefore, whether to start current protection is determined by comparing the feedback signal FB11 with the square waveform Vs to judge statuses of the low dropout regulator 32.

Figure 6:
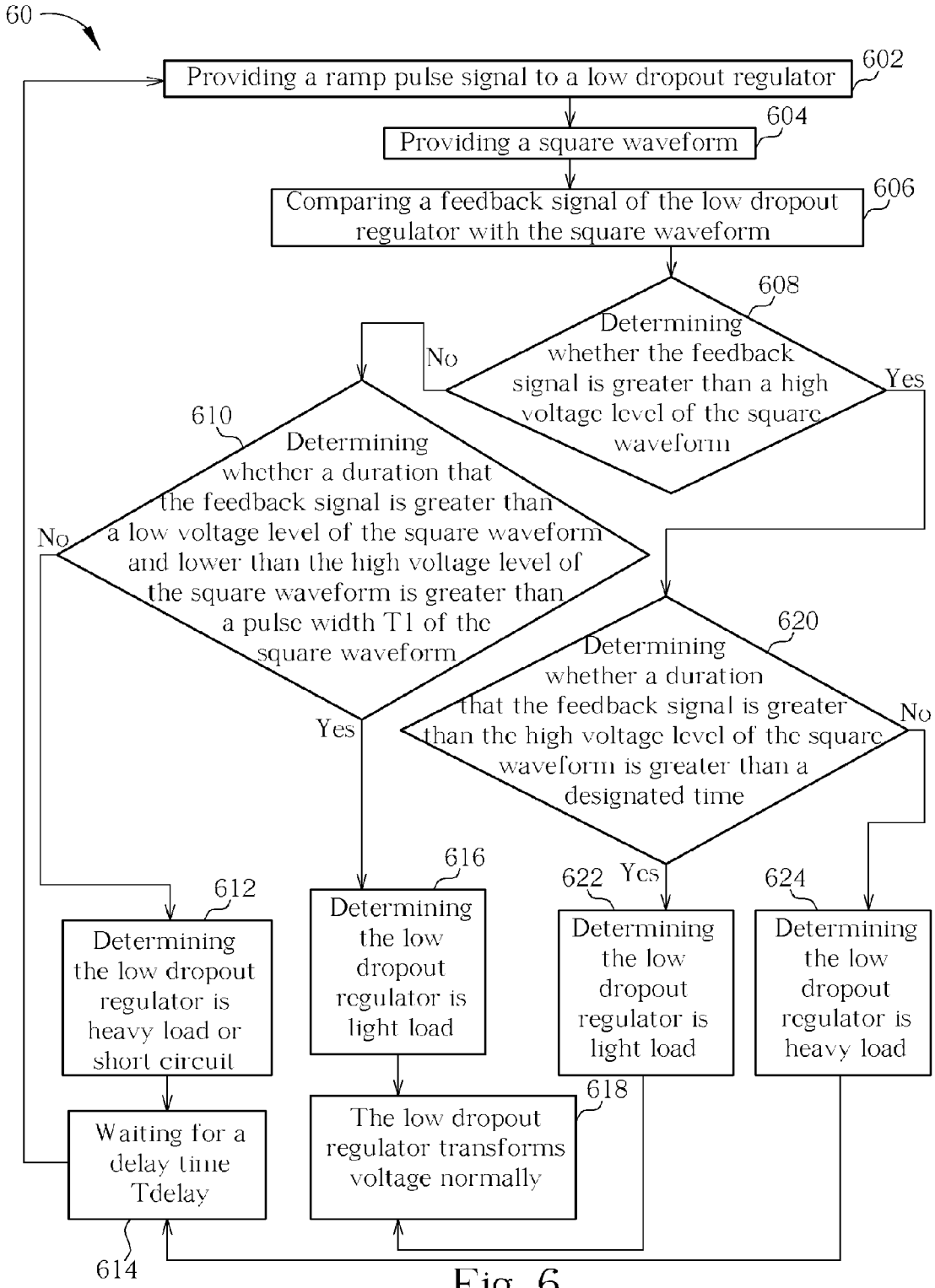
FIG. 6 is a diagram illustrating a flow of a method capable of sensing a heavy load and a short circuit of the low dropout regulator according to an embodiment of the present invention.

Please refer to FIG. 6. FIG. 6 is a diagram illustrating a flow 60 of a method capable of sensing a heavy load and a short circuit of the low dropout regulator according to an embodiment of the present invention. The flow 60 includes the following steps:

Step 602: Providing a ramp pulse signal to a low dropout regulator.

Step 604: Providing a square waveform.

Step 606: Comparing a feedback signal of the low dropout regulator with the square waveform.

Step 608: Determining whether the feedback signal is greater than a high voltage level of the square waveform.

Step 610: Determining whether a duration that the feedback signal is greater than a low voltage level of the square waveform and lower than the high voltage level of the square waveform is greater than a pulse width T1 of the square waveform.

Step 612: Determining the low dropout regulator is a heavy load or a short circuit if the duration that the feedback signal is greater than a low voltage level of the square waveform and lower than the high voltage level of the square waveform is not greater than a pulse width T1 of the square waveform.

Step 614: Waiting for a delay time Tdelay.

Step 616: Determining the low dropout regulator is a light load if the duration that the feedback signal is greater than the low voltage level of the square waveform and smaller than the high voltage level of the square waveform is greater than the pulse width T1 of the square waveform.

Step 618: The low dropout regulator transforms voltage normally.

Step 620: Determining whether a duration that the feedback signal is greater than the high voltage level of the square waveform is greater than a designated time.

Step 622: Determining the low dropout regulator is a light load if the duration that the feedback signal is greater than the high voltage level of the square waveform is greater than the designated time.

Step 624: Determining the low dropout regulator is a heavy load if the duration that the feedback signal is greater than the high voltage level of the square waveform is not greater than the designated time.

In step 602, the ramp pulse signal is supplied to the low dropout regulator first, and the feedback signal is fed back by the low dropout regulator. In step 604, the provided square waveform has a low voltage level being the first threshold voltage Vth1, a high voltage level being the second threshold voltage Vth2, and a pulse width being T1. In step 606, the feedback signal is compared with the square waveform. In step 610-624, whether to provide the ramp pulse signal to the low dropout regulator after waiting for the delay time Tdelay or not is determined according to compare results to determine the low dropout regulator is a heavy load or a light load. The low dropout regulator is determined a heavy load or a short circuit if the duration that the feedback signal is greater than a low voltage level of the square waveform and lower than the high voltage level of the square waveform is not greater than the pulse width T1 of the square waveform (step 612). The low dropout regulator is determined a heavy load if the duration that the feedback signal is greater than the high voltage level of the square waveform is not greater than the designated time (step 624). The ramp pulse signal is provided to the low dropout regulator (return to step 602) after waiting for the delay time Tdelay (step 614) when the low dropout regulator is determined a heavy load or a short circuit. The low dropout regulator is determined a light load if the duration that the feedback signal is greater than the low voltage level of the square waveform and smaller than the high voltage level of the square waveform is greater than the pulse width T1 of the square waveform (step 616). The low dropout regulator is determined a light load if the duration that the feedback signal is greater than the high voltage level of the square waveform is greater than the designated time (step 622). The low dropout regulator transforms voltage normally when the low dropout regulator is determined a light load (step 618).

Figure 7:
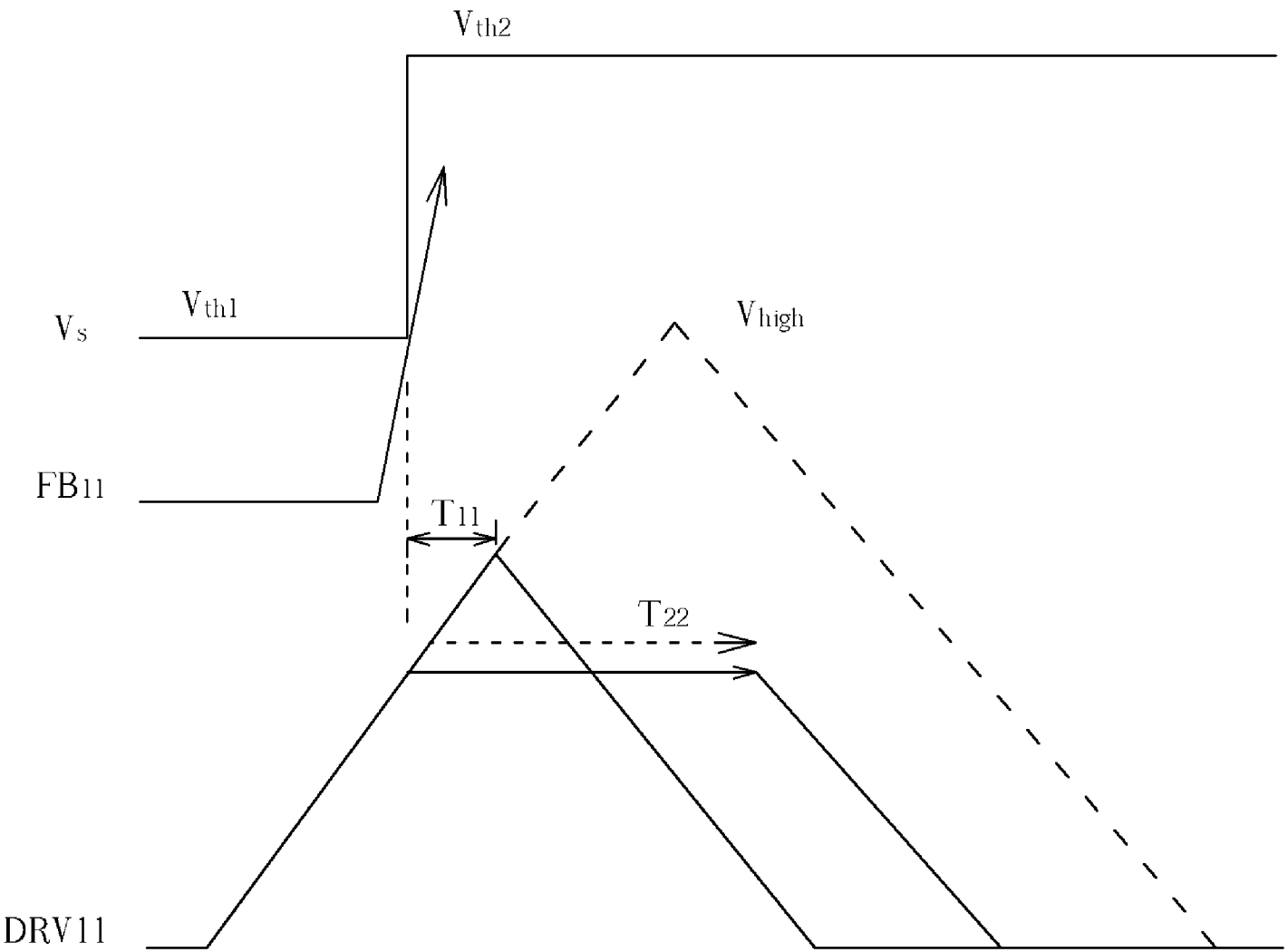
FIG. 7 is a diagram illustrating a setting of the driving signal in FIG. 4.

Please refer to FIG. 7 that is a diagram illustrating a setting of the driving signal DRV11 in FIG. 4. As shown in FIG. 7, the driving signal DRV11 is relative to the feedback signal FB11. It indicates that the driving signal DRV11 has enough driving strength to drive the transistor Q1 if the feedback signal FB11 reaches the low voltage level of the square waveform Vs (the first threshold voltage Vth1). Hence, V(FB11)=Vth1 is set as the start point, and the driving signal DRV11 can continue rising for a first time T11 with the same slope or keep at the same voltage level for a second time T22. An objective is to ensure that the feedback signal FB11 has enough energy to reach the high voltage level of the square waveform Vs (the second threshold voltage Vth2) or charge the output capacitor in a normal load. The driving signal DRV11 can be a triangle waveform, a square waveform, or waveforms in other types, and its slope can be adjusted depending on user's demand.

Figure 8:
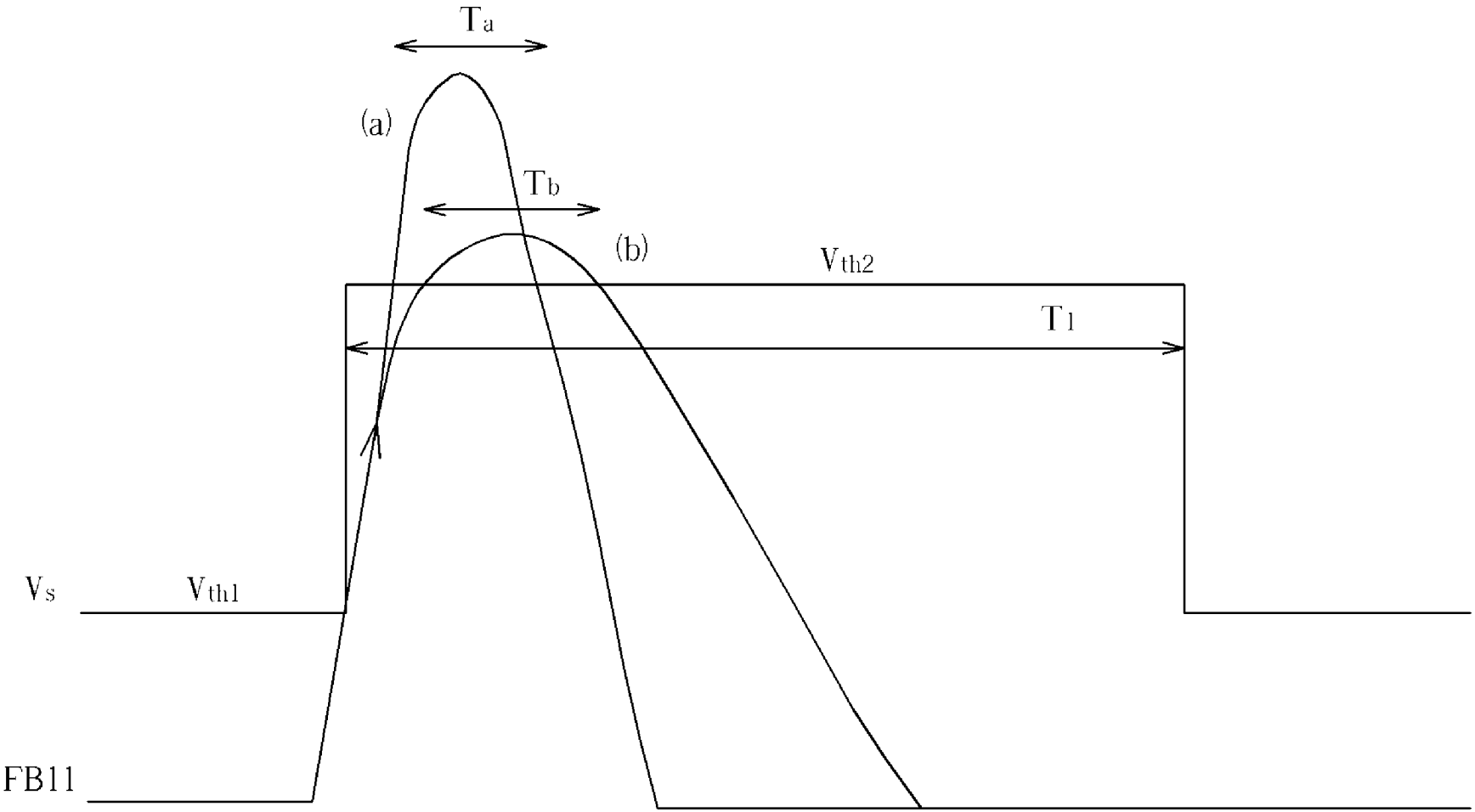
FIG. 8 is a diagram illustrating a setting of the square waveform in FIG. 4.
Figure 9:
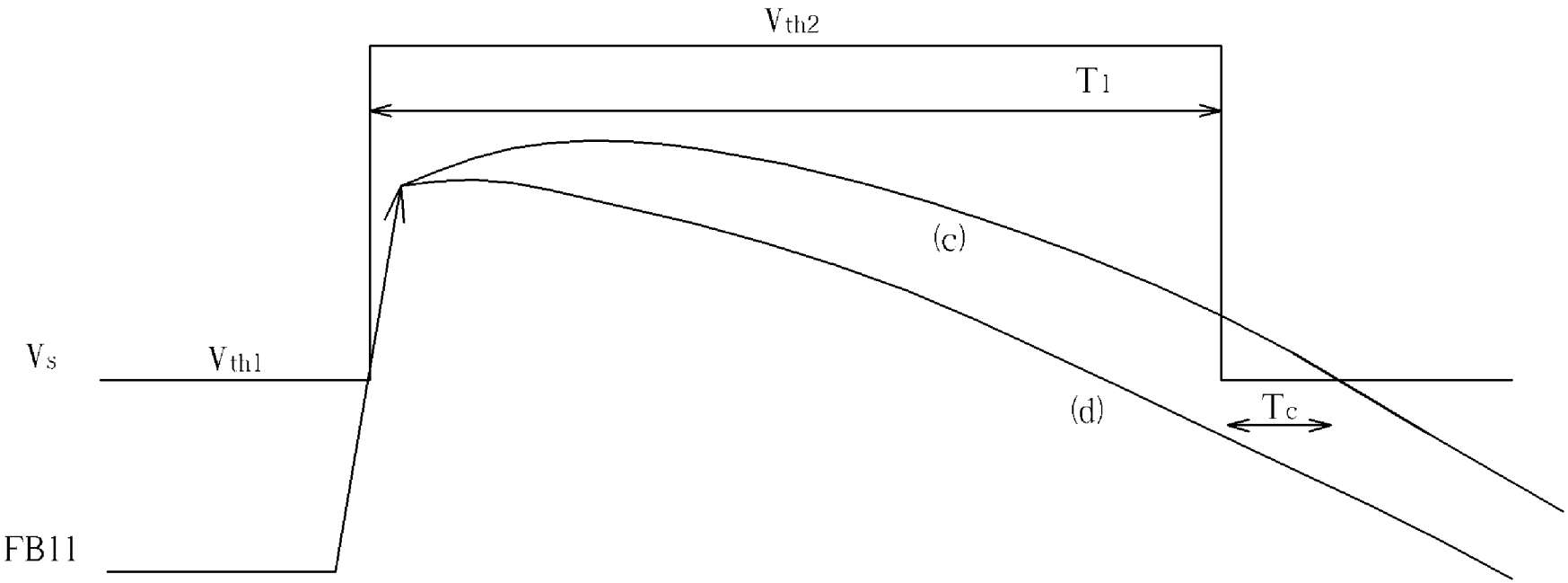
FIG. 9 is a diagram illustrating another setting of the square waveform in FIG. 4.

Please refer to FIG. 8 that is a diagram illustrating a setting of the square waveform Vs in FIG. 4. The setting of the square waveform Vs is relative to applications of the low dropout regulator 32. As shown in FIG. 8, the upper waveform is the square waveform Vs, and the lower waveforms are two possible feedback waveforms FB11. Assume that the second threshold voltage Vth2 is twice as big as the first threshold voltage Vth1 (Vth2=2×Vth1). The feedback signal FB11 can reach the first threshold voltage Vth1 through the driving energy provided by a rising part of the driving signal DRV11 and reach the second threshold voltage Vth2 (Vth1+Vth1) through the driving energy provided by a falling part of the driving signal DRV11. Different output capacitors Cout will result in different waveforms of the feedback signal FB11 such as waveforms (a) and (b) in FIG. 8 and waveforms (c) and (d) in FIG. 9. The waveforms (a) and (b) in FIG. 8 are applied to the output capacitor Cout with small capacitance, and the waveforms (c) and (d) in FIG. 9 are applied to the output capacitor Cout with a large capacitance. The pulse width T1 of the square waveform Vs is designed to detect whether the low dropout regulator 32 is a heavy load under a large capacitance.

Please refer to the waveforms (a) and (b). A duration that the waveform (a) is greater than the second threshold voltage Vth2 is a time Ta, and a duration that the waveform (b) is greater than the second threshold voltage Vth2 is a time Tb. The time Tb is used as a reference point, and the low dropout regulator is determined a heavy load if a waveform has a duration that is greater than the second threshold voltage Vth2 is smaller than the time Tb. For example, the time Ta is smaller than the time Tb, thus the waveform (a) is determined a heavy load.

Please refer to FIG. 9 that is a diagram illustrating another setting of the square waveform Vs in FIG. 4. Different output capacitors Cout will result in different waveforms of the feedback signal FB11 such as waveforms (c) and (d) in FIG. 9. The waveforms (c) and (d) in FIG. 9 are applied to the output capacitor Cout with a large capacitance. Please refer to the waveforms (c) and (d). A duration that the waveform (c) is greater than the first threshold voltage Vth1 and smaller than the second threshold voltage Vth2 is a time Tc, and a duration that the waveform (d) is greater than the first threshold voltage Vth1 and smaller than the second threshold voltage Vth2 is a time Td. The time (T1+Tc) is used as a reference point, and the low dropout regulator is determined a heavy load if a waveform has a duration that is greater than the first threshold voltage Vth1 and smaller than the second threshold voltage Vth2 is smaller than the time (T1+Tc). For example, the time Td is smaller than the time (T1+Tc), thus the waveform (d) is determined a heavy load.

Figure 10:
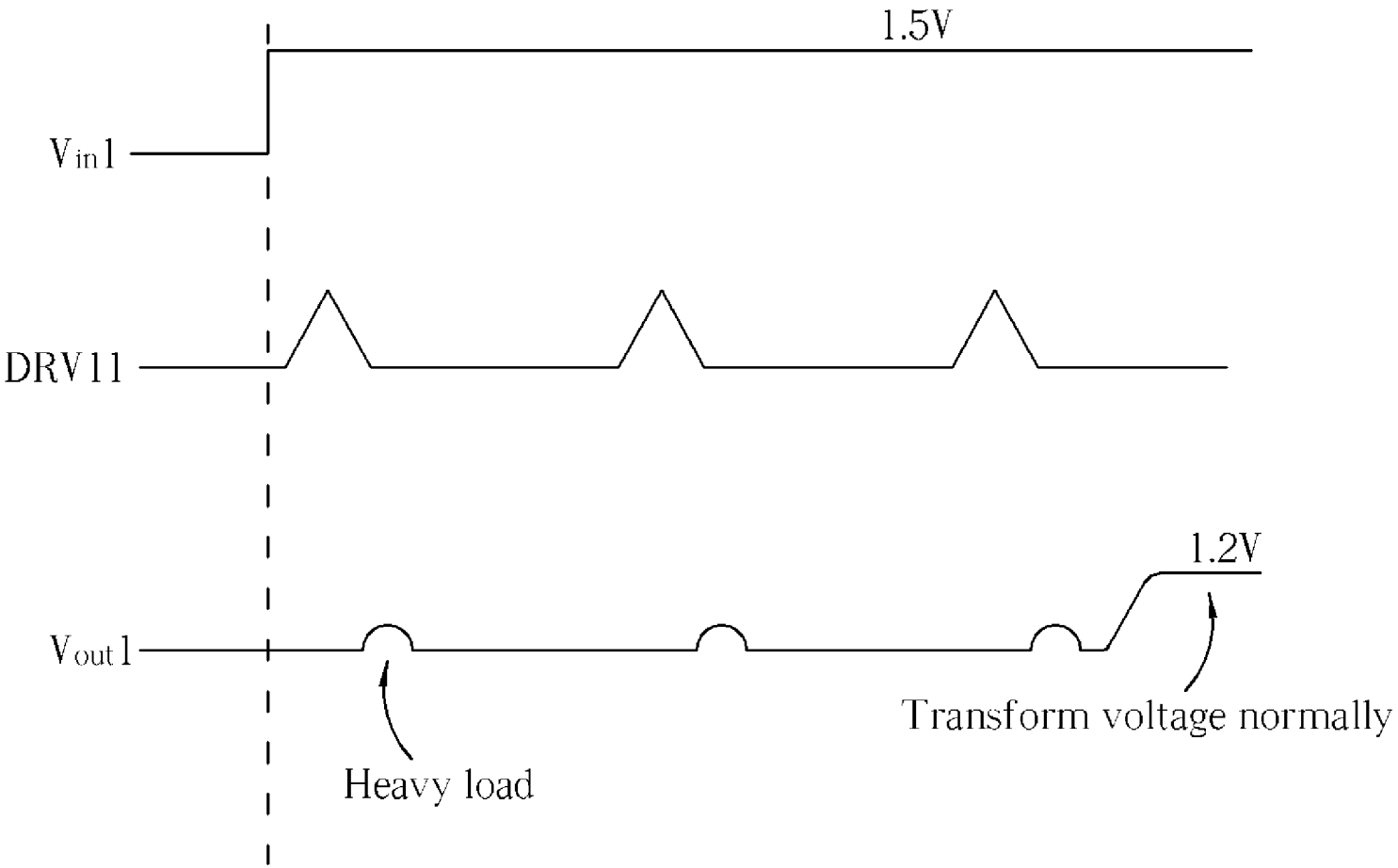
FIG. 10 is a diagram illustrating how to sense a heavy load and a short circuit of a low dropout regulated circuit according to an embodiment of the present invention.

Please refer to FIG. 10. FIG. 10 is a diagram illustrating how to sense a heavy load and a short circuit of a low dropout regulated circuit according to an embodiment of the present invention. The low dropout regulator is used for transforming the input voltage Vin1 into the output voltage Vout1. As shown in FIG. 10, the upper waveform is the input voltage Vin1 and has a voltage 1.5V, the middle waveform is the driving signal DRV11 and will provide a ramp pulse to the driving signal DRV11 every delay time Tdelay, and the lower waveform is the output voltage Vout1 and has a voltage 1.2V. Whenever a ramp pulse is transmitted by the driving signal DRV11, the input voltage Vin1 is not transformed into the output voltage Vout1 if the low dropout regulator is determined a heavy load (at this time the output voltage Vout1 is about zero) until the low dropout regulator is determined a light load (at this time the output voltage vout1 is 1.2V). Therefore, whether to start current protection is determined by this compare mechanism of judging statuses of the low dropout regulator 32.

The abovementioned embodiments are presented merely for describing the present invention, and in no way should be considered to be limitations of the scope of the present invention. The low voltage level of the square waveform Vs (the first threshold voltage Vth1), the high voltage level (the second threshold voltage Vth2), and the pulse width T1 is not limited to fixed values and can be adjusted depending on kinds of the driving transistor Q1 and user's demand. The ramp pulse signal Vt and the driving signal DRV11 are not limited to a triangle waveform only, and can be a square waveform or waveforms in other types. The driving circuit 35 is not restricted to an error amplifier and other elements may also be utilized for implementing the driving circuit 35. The compare circuit 36 is not restricted to a comparator. Furthermore, the driving transistor Q1 is not limited to a MOS only, and other elements may also be adopted.

From the above descriptions, the present invention provides a method and related controller capable of sensing a heavy load and a short circuit of a low dropout regulator. By comparing the feedback signal FB11 with the square waveform Vs to determine whether the low dropout regulator 32 is a heavy load or a short circuit, current protection is determined to start or not. The controllers 34 and 44 of the present invention could provide current protection to the low dropout regulated circuits 30 and 40 to prevent the driving transistor Q1 from burning out, decrease power consumption of chipsets, and improve system stability when the low dropout regulator 32 operates under conditions of a heavy load or a larger current. Besides, the low dropout regulated circuits 30 and 40 still have characteristics such as quick response, stable output voltage, low cost and small package that is suitable to analog circuits and critical voltages. Moreover, the low voltage level, the high voltage level, and the pulse width of the square waveform Vs can be adjusted to confirm to a different driving transistor Q1 and can be applied to wider applications.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method capable of sensing a heavy load and a short circuit of a low dropout regulator, the method comprising:

providing a ramp pulse signal to the low dropout regulator;

providing a square waveform;

comparing a feedback signal of the low dropout regulator with the square waveform; and determining that the low dropout regulator has a heavy load or short circuit if a duration that the feedback signal is greater than a low voltage level of the square waveform and lower than a high voltage level of the square waveform is not greater than a pulse width of the square waveform.

2. The method of claim 1, wherein providing the ramp pulse signal to the low dropout regulator is providing a triangle waveform to the low dropout regulator.

3. The method of claim 1, wherein providing the ramp pulse signal to the low dropout regulator is providing a square waveform to the low dropout regulator.

4. The method of claim 1, further comprising:

determining that the low dropout regulator has a light load if the duration that the feedback signal is greater than the low voltage level of the square waveform and lower than the high voltage level of the square waveform is greater than the pulse width of the square waveform.

5. The method of claim 1, further comprising:

determining that the low dropout regulator has a light load if a duration that the feedback signal is greater than the high voltage level of the square waveform is greater than a designated time.

6. The method of claim 5, further comprising:

the low dropout regulator transforming voltage normally when the low dropout regulator is determined to have a light load.

7. The method of claim 5, further comprising:

determining that the low dropout regulator has a heavy load if the duration that the feedback signal is greater than the high voltage level of the square waveform is not greater than the designated time.

8. The method of claim 7, further comprising:

providing the ramp pulse signal to the low dropout regulator after waiting for a delay time when the low dropout regulator is determined to have a heavy load or a short circuit.

9. A controller capable of sensing a heavy load and a short circuit of a low dropout regulator, the controller comprises:

a driving circuit used for providing a driving signal to the low dropout regulator;

a square waveform generator used for providing a square waveform;

a compare circuit used for comparing a feedback signal of the low dropout regulator with the square waveform; and a judgment module used for determining that the low dropout regulator has a heavy load or short circuit if a duration that the feedback signal is greater than a low voltage level of the square waveform and lower than a high voltage level of the square waveform is not greater than a pulse width of the square waveform.

10. The controller of claim 9, wherein the judgment module is further used for:

determining that the low dropout regulator has a light load if the duration that the feedback signal is greater than the low voltage level of the square waveform and lower than the high voltage level of the square waveform is greater than the pulse width of the square waveform.

11. The controller of claim 9 wherein the judgment module is further used for:

determining that the low dropout regulator has a light load if a duration that the feedback signal is greater than the high voltage level of the square waveform is greater than a designated time.

12. The controller of claim 11, wherein the judgment module is further used for:

determining that the low dropout regulator has a heavy load if the duration that the feedback signal is greater than the high voltage level of the square waveform is not greater than the designated time.

13. The controller of claim 9, wherein the driving circuit is an error amplifier having a first input end, a second input end, a control end, and an output end, the first input end used for receiving a ramp pulse signal, the second input end coupled to the output end, the control end coupled to an output end of the judgment module for receiving a judgment signal, the output end coupled to a control end of the low dropout regulator, the error amplifier used for generating the driving signal according to the judgment signal.

14. The controller of claim 9, wherein the compare circuit is a comparator having a first input end, a second input end, and an output end, the first input end coupled to the low dropout regulator for receiving the feedback signal, the second input end coupled to the square waveform generator for receiving the square waveform, the output end used for outputting a compare signal, the comparator used for generating the compare signal according to a result of comparing the feedback signal with the square waveform.

15. The controller of claim 14, wherein the judgment module is used for generating the judgment signal to the driving circuit according to the compare signal.

16. The controller of claim 9 wherein the low dropout regulator comprises:

a switch having a control end, a first end, and a second end, the control end used for receiving the driving signal, the first end used for receiving an input voltage, the second end used for outputting an output voltage, the low dropout regulator used for transforming the input voltage into the output voltage;

a first resistor having a first end and a second end, the first end coupled to the second end of the switch, the second end used for outputting the feedback signal; and a second resistor having a first end and a second end, the first end coupled to the second end of the first resistor with series connection, the second end coupled to ground.

17. The controller of claim 16, wherein the switch is a metal-oxide semiconductor transistor (MOS).

18. The controller of claim 16, wherein the low dropout regulator further comprises a load coupled between the switch and the first resistor.

19. The controller of claim 16, wherein the low dropout regulator farther comprises a capacitor coupled to the first end of the switch.

20. The controller of claim 9, further comprising:

a third resistor having a first end and a second end, the first end coupled to the output end of the error amplifier, the second end coupled to the second input end of the error amplifier; and a fourth resistor having a first end and a second end, the first end coupled to the third resistor and to the second input end of the error amplifier, the second end coupled to ground;

wherein the third resistor and the fourth resistor are used for adjusting an amplification factor of the error amplifier.

* * * * *